US006200162B1

(12) United States Patent
Aoyama et al.

(10) Patent No.: US 6,200,162 B1
(45) Date of Patent: Mar. 13, 2001

(54) SHIELDING TERMINAL

(75) Inventors: Masahiko Aoyama; Masashi Saito; Takashi Koide, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/443,801

(22) Filed: Nov. 19, 1999

(30) Foreign Application Priority Data

Nov. 19, 1998 (JP) ..... 10-329685

(51) Int. Cl.[7] ..... H01R 09/05
(52) U.S. Cl. ..... 439/578; 439/585
(58) Field of Search ..... 439/585, 583, 439/578, 610, 395, 607, 608, 609, 101, 108

(56) References Cited

U.S. PATENT DOCUMENTS

| | | | |
|---|---|---|---|
| 4,010,538 | 3/1977 | O'Keefe et al. . | |
| 4,337,989 | 7/1982 | Asick et al. . | |
| 5,145,409 | 9/1992 | Sato et al. . | |
| 5,169,340 | 12/1992 | Nakata et al. . | |
| 5,409,400 | 4/1995 | Davis . | |
| 5,580,268 | 12/1996 | Miyazawa . | |
| 5,667,404 | 9/1997 | Kato et al. . | |
| 5,725,395 * | 3/1998 | Lee | 439/610 |

* cited by examiner

*Primary Examiner*—Gary F. Paumen
*Assistant Examiner*—Phuongchi Nguyen
(74) *Attorney, Agent, or Firm*—Anthony J. Casella; Gerald E. Hespos; Michael J. Porco

(57) ABSTRACT

An inner terminal 11 is accommodated in an accommodating portion 20 of an outer terminal 12 via a dielectric element 13. A core 2 of a shielded cable 1 is fastened to an inner fastening portion 18 of the inner terminal 11 outside the outer terminal 12, and then the inner terminal 11 is inserted into the dielectric element 13. A braided wire 4 is folded back around an end of a sheath 5, and an outer fastening portion 22 of the outer terminal 12 is fastened to a folded portion 4A thereof. A covering wall portion 21 in which only the upper surface is open is provided between the accommodating portion 20 and the outer fastening portion 22 of the outer terminal 12, and the inner fastening portion 18 is located in the covering wall portion 21. Upon the completion of crimping, the shielding terminal 10 is fixed by inserting the cover 14 into the opening 21A of the covering wall portion 21 and thereby elastically holding the outer fastening portion 22 by holding pieces 39 of a clip portion 37 from opposite lateral sides. As a result, the core 2 has its fastened portion and a portion near it covered on four sides by conductive members.

6 Claims, 6 Drawing Sheets

SHIELDING TERMINAL

BACKGROUND OF THE INVENTION

1. Field of the Invention

The present invention relates to a shielded or shielding terminal to be connected with an end of a shielded cable.

2. Description of the Related Art

A prior art shielding terminal is shown in FIGS. 6 and 7. This prior art shielding terminal is comprised of an inner terminal "a" to be connected with a mating terminal and an outer terminal "c" in the form of a rectangular tube that accommodates the inner terminal via a dielectric element "b". A core fastening portion "h" is provided in the inner terminal "a" and is crimped into connection with the end of a core "e" of a shielded cable "d". Similarly a braided wire fastening portion "i" and a sheath fastening portion "j" are provided at the outer terminal "a" and are crimped into connection with an end of a braided wire "f" and an end of a sheath "g", respectively.

When the shielding terminal is crimped by a terminal mounting apparatus, the core "e", the braided wire "f" and the sheath "g" are connected simultaneously. It is essential, therefore, to form windows "k" in the upper and lower surfaces of the outer terminal "c" so that a crimper can access and crimp the core fastening portion "h" of the inner terminal "a" accommodated in the outer terminal "c".

This means that a portion of the fastened end of the core "e" has its upper and lower surfaces exposed through the windows "k", thereby undesirably reducing shielding characteristics, such as a radiation characteristic.

In view of the above problem, an object of the present invention is to provide a shielding terminal having improved shielding characteristics.

SUMMARY OF THE INVENTION

According to the invention, there is provided a shielding terminal that is connectable with an end of a shielded cable. The shielded cable is formed by coaxially arranging a core and a shield layer, such as a braided wire, with an insulating layer therebetween and covering the outer surface of the shield layer by a sheath. The shielding terminal comprises an inner terminal to be crimped into connection with the core and an outer terminal to be connected with the shield layer. The outer terminal is configured for accommodating the inner terminal with a dielectric element provided between the inner and outer terminals. A cover member is provided for substantially covering an exposed portion of the inner terminal near its fastening portion to the core. The cover member preferably is detachably mountable on a fastening portion of the outer terminal to the shield layer. Since the exposed portion of the inner terminal near its fastening portion to the core is covered by the cover member, shielding characteristics, such as a radiation characteristic, can be improved.

According to a preferred embodiment of the invention, the cover member is detachably mountable on a fastening portion of the outer terminal to the shield layer. Accordingly, the shielding terminal can be made smaller and simpler by simplifying the mount construction.

According to a further preferred embodiment, the inner terminal is crimped into connection with the core at a location outside the outer terminal. The shield layer, in particular the braided wire, then preferably is folded back onto the sheath. The outer terminal includes the fastening portion for fastening the folded back portion of the shield layer together with the sheath. A covering wall portion may be provided for substantially covering the fastening portion of the inner terminal to the core on three sides. The cover member is formed to substantially close an opening of the covering wall portion and is detachably mountable on the fastening portion of the outer terminal.

These embodiments have several advantages. For example, the shielding terminal can be made smaller. Additionally, a crimper is allowed to have a simple construction. Furthermore, the fastening portion of the inner terminal to the core can be covered on four sides by the covering wall portion of the outer terminal and by the cover member. Thus, shielding characteristics can be improved more securely.

Preferably, a portion of the cover member mountable on the fastening portion of the outer terminal is formed into a clip for elastically holding the fastening portion. Since the mount portion of the cover member is in the form of a clip, the cover member can be easily and strongly mounted.

Most preferably, the cover comprises a covering portion positioned radially inwardly and longitudinally displaced from a radially outward surface of the outer terminal. Thus the outer terminal comprises an edge portion, which can act as an engaging portion for a locking portion of an external housing.

These and other objects, features and advantages of the present invention will become more apparent upon a reading of the following detailed description and accompanying drawings.

DETAILED DESCRIPTION OF THE PREFERRED EMBODIMENT

Figure 1:
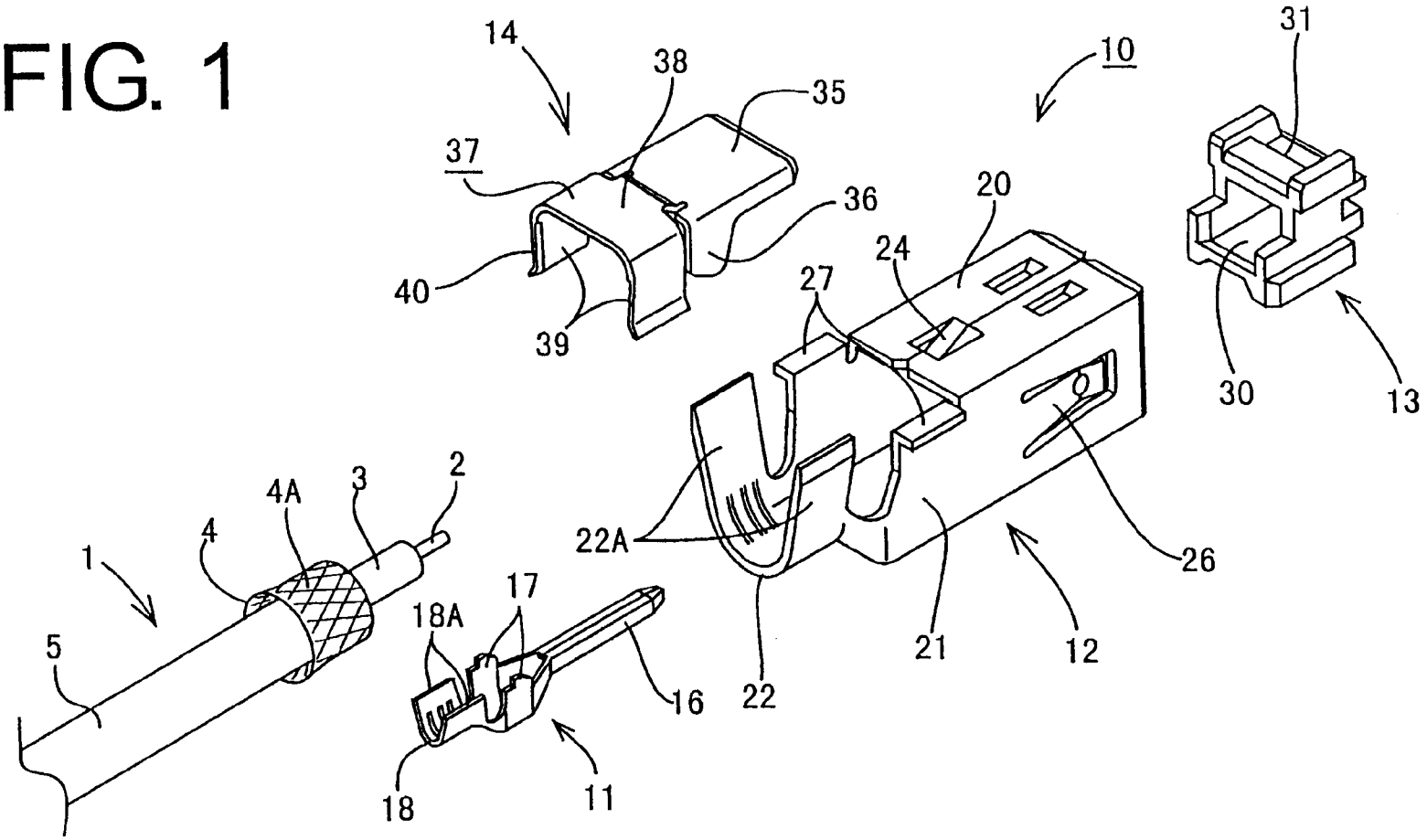
FIG. 1 is an exploded perspective view of one embodiment of the invention.
Figure 2:
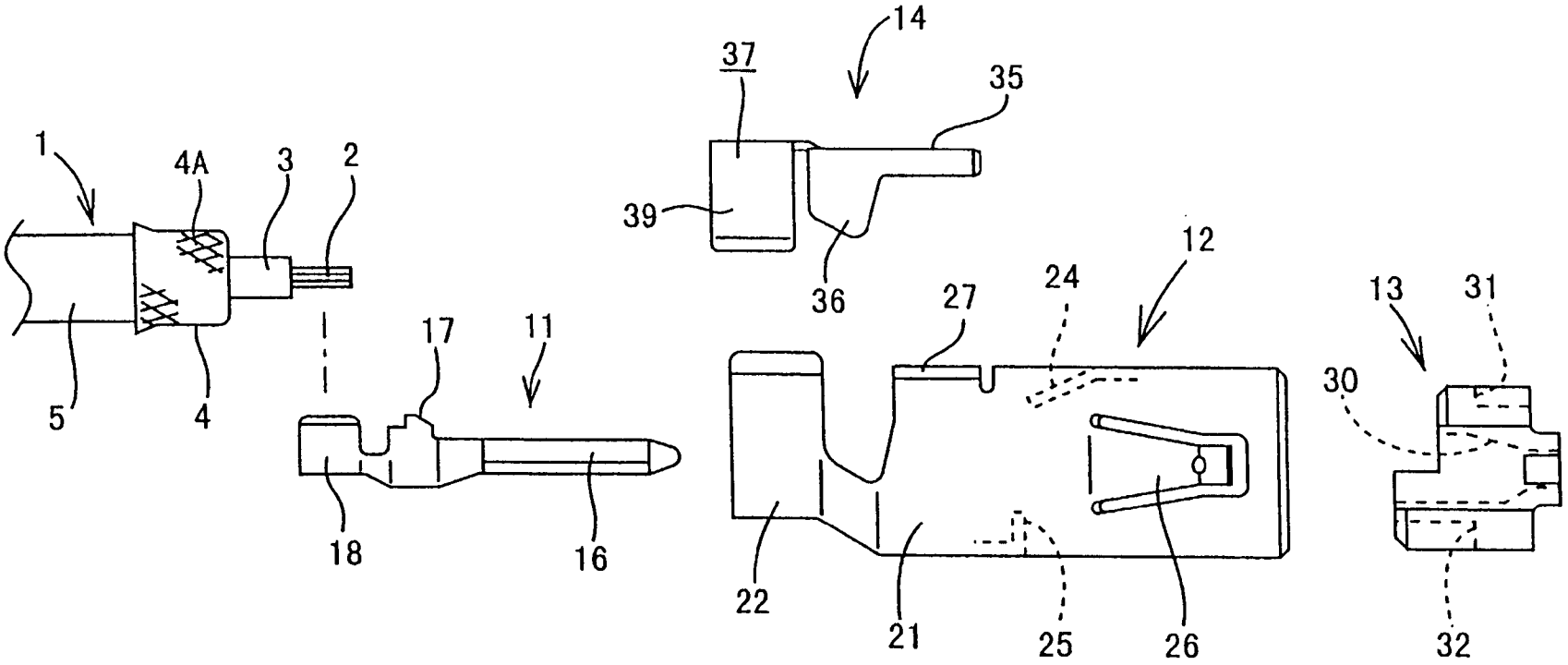
FIG. 2 is an exploded side view of the embodiment.
Figure 3:
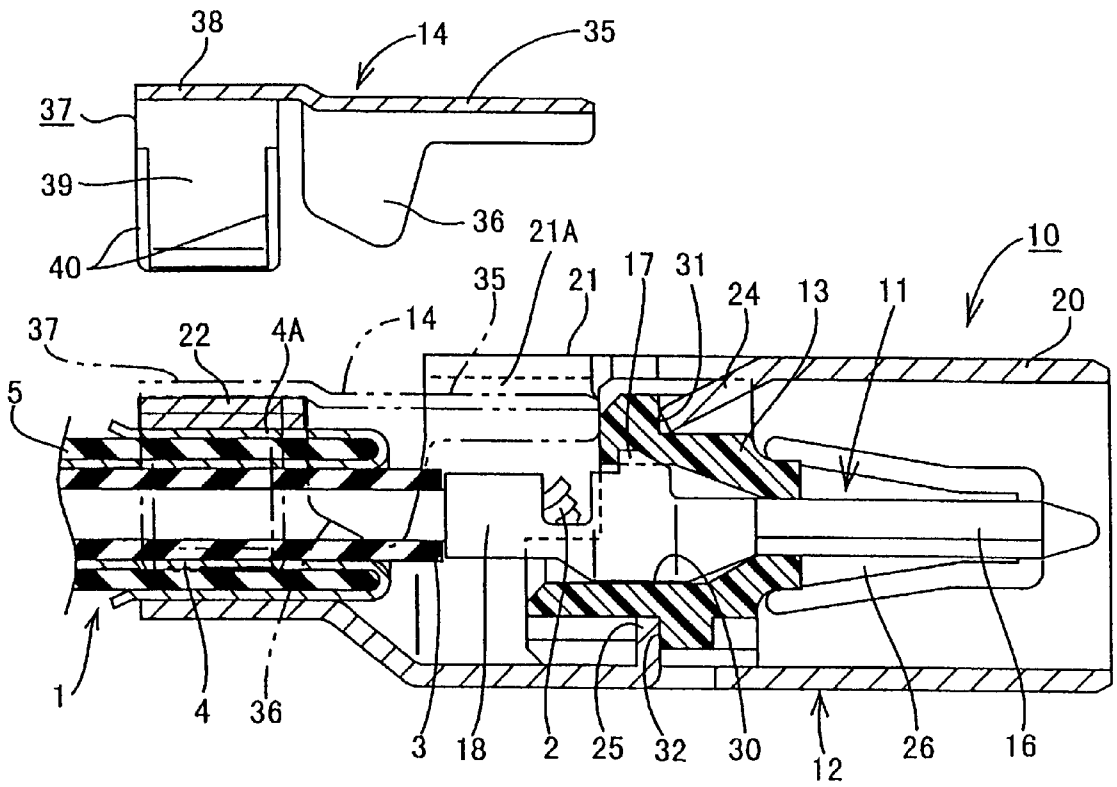
FIG. 3 is a vertical section showing a state before a cover is mounted.
Figure 4:
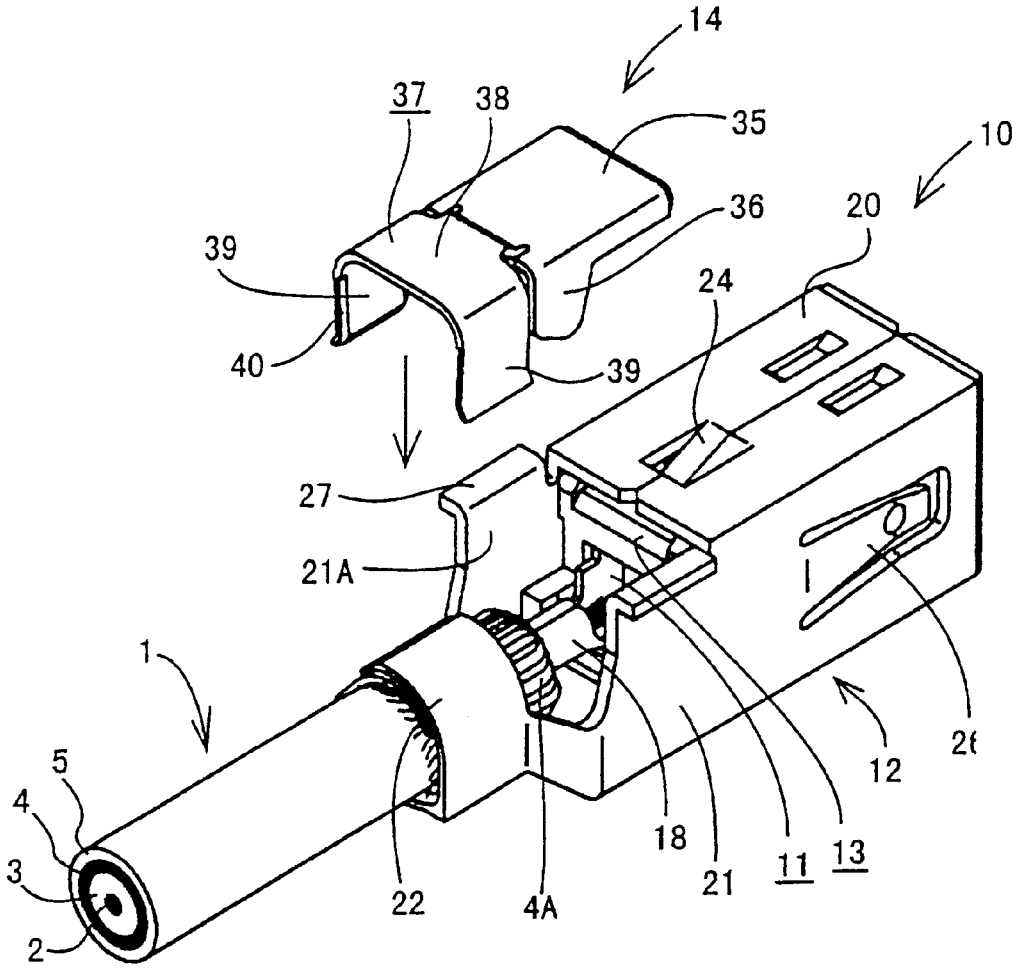
FIG. 4 is a perspective view showing the state of FIG. 3.

A male shielding terminal 10 in accordance with the subject invention is identified by the numeral 10 in FIGS. 1–5. The male shielding terminal 10 is used by being fastened to an end of a shielded cable 1. The shielded cable 1 has a known structure with a core 2 formed, for example, by twisting a plurality of strands. An insulating layer 3 surrounds the core 2 and a shield layer or braided wire 4 surrounds the insulating layer 3. A sheath 5 made, for example, of rubber or like material coaxially surrounds the shield layer 4 as shown in FIGS. 1 and 4. An end processing is performed on the shielded cable 1 by stripping a portion of the sheath 5 to expose a section of the braided wire 4. The exposed section of the braided wire 4 then is folded back around the sheath 5 to define a folded portion 4A. The end processing also removes an exposed end of the insulating layer 3 to expose part of the core 2.

The shielding terminal 10 is comprised of an inner terminal 11, an outer terminal 12, a dielectric element 13 and a cover 14 as shown in FIGS. 1 and 2.

The inner terminal 11 is formed into a male terminal, for example, by bending a conductive metal plate, and is provided with a tab portion 16 to be connected with a mating female inner terminal (not shown). Biting projections 17 are formed on the inner terminal 11. The biting projections 17 bite in or are inserted or cut into the inner wall of the dielectric element 13 when the inner terminal 11 is pushed into the dielectric element 13. The inner terminal 11 further is formed with an inner fastening portion 18 to be crimped into connection with the core 2 of the shielded cable 1. The tab portion 16, the biting projections 17 and the inner fastening portion 18 are arranged in this order from the leading end side of the inner terminal 11. The inner fastening portion 18 includes a pair of fastening pieces 18A and initially is open laterally or upwardly.

The outer terminal 12 is likewise formed, for example, by bending a conductive metal plate and is provided with an accommodating portion 20 in the form of a substantially rectangular tube. The outer terminal 12 also is formed with a covering wall portion 21 having an open upper surface. An outer fastening portion 22 is provided for crimped connection with the folded portion 4A of the braided wire 4 of the shielded cable 1. The accommodating portion 20, the covering wall portion 21 and the outer fastening portion 22 are arranged in this order from the leading end side of the outer terminal 12.

The upper wall of the accommodating portion 20 is formed with a metal locking portion 24 for locking the dielectric element 13 and preventing the dielectric element 13 from coming out through the front opening of the accommodating portion 20. The metal locking portion 24 is formed by cutting a portion of the upper wall of the accommodating portion 20 and bending this cut portion inwardly to extend obliquely backward. Further, as shown in FIG. 3, a stopper 25 is formed in the bottom wall of the accommodating portion 20 for coming into abutment against the rear surface of the dielectric element 13 and for preventing the dielectric element 13 from moving backward. The left and right side walls of the accomodating portion 20 are formed with contact pieces 26 which can be brought elastically into contact with a mating female outer terminal.

The covering wall portion 21 of the outer terminal 12 is comprised of bottom, left and right walls to be substantially closed on three sides, and the inner fastening portion 18 of the inner terminal 11 that is fastened to the core 2 of the shielded cable 1 is located substantially inside the covering wall portion 21. Stabilizers 27 project transversely outwardly from the upper edges of the left and right side walls of the covering wall portion 21.

The outer fastening portion 22 similarly includes a pair of fastening pieces 22A and initially is open upwardly.

The dielectric element 13 is made of an insulating material such as a synthetic resin, and functions to electrically insulate the inner and outer terminals 11, 12 from each other. The dielectric element 13 is fittable into a rear end side of the accommodating portion 20 of the outer terminal 12, and is formed with an accommodating hole 30 for at least partially accommodating the inner terminal 11 between the base end of the tab portion 16 and a portion of the inner terminal 11 where the biting projections 17 are provided. A locking hole 31 is formed in the upper surface of the dielectric element 13 for receiving the metal locking portion 24 of the outer terminal 12, is fittable and a contact portion 32 is formed in the lower surface of the dielectric element 13 for contacting the stopper 25 of the outer terminal 12.

The cover 14 is formed into the shape as shown in FIG. 4, for example, by bending a conductive metal plate. More specifically, the cover 14 has a covering portion 35 for substantially completely covering from an opening 21A in the upper surface of the covering wall portion 21 of the outer terminal 12 to the crimped outer fastening portion 22. Left and right edges of the covering portion 35 are bent downward to function as guides, and a pair of hanging portions 36 are formed at the rear end of the covering portion 35 to cover rear parts of the left and right walls of the covering wall portion 21.

A clip portion 37 is continuously formed at the rear end of the covering portion 35. The clip portion 37 includes a base plate 38 located slightly above the covering portion 35 and a pair of holding pieces 39 hanging downward from the left and right edges of the base plate 38. The holding pieces 39 are elastically deformable in directions away from each other to hold the crimped outer fastening portion 22 elastically. The bottom ends of the respective holding pieces 39 are bent slightly outward, and biting projections 40 which bite into the outer surface of the outer fastening portion 22 are formed at the front and rear edges of the inner surface of the respective holding pieces 39.

An operation of fastening the shielding terminal 10 to the end of the shielded cable 1 is performed in the following procedure. End processing is applied to the shielded cable 1 as already described. The fastening pieces 18A of the inner fastening portion 18 of the inner terminal 11 are crimped and fastened to the end of the core 2 of the shielded cable 1.

Subsequently, the dielectric element 13 is inserted into the accommodating portion 20 of the outer terminal 12 from front or from a side substantially opposed to the cable insertion side. The dielectric element 13 is pushed while elastically deforming the metal locking portion 24. When the contact portion 32 comes into contact with the stopper 25 as shown in FIG. 3, the metal locking portion 24 is at least partly restored to its original shape, thereby being slipped into the locking hole 31. As a result the dielectric element 13 is fixed in a specified position at the rear end of the accommodating portion 20.

Next, the inner terminal 11 is inserted into the accommodating portion 20 of the outer terminal 12, and is maneuvered by a jig inserted through the opening 21A in the upper surface of the covering wall portion 21 to push the tab portion 16 into the accommodating hole 30 of the dielectric element 13. During this stage, the biting projections 17 bite in the inner wall of the accommodating hole 30. As a result that the inner terminal 11 is fixed while the tab portion 16 is at least partly projecting from the dielectric element 13 as shown in FIG. 3. In this way, the inner terminal 11 is accommodated in the outer terminal 12 via the dielectric element 13. Here, the inner fastening portion 18 of the inner terminal 11 is located in the wall covering portion 21 of the outer terminal 12, and the folded portion 4A of the braided wire 4 of the shielded cable 1 is located in the outer fastening portion 22 of the outer terminal 12.

The open outer fastening portion 22 is crimped by a crimper. Both fastening pieces 22A are crimped to surround the folded portion 4A of the braided wire 4 in such a manner that the end of one fastening piece 22A is placed on that of the other fastening piece 22A. Consequently, the fastening pieces 22A fasten the folded portion 4A of the braided wire 4 and the end of the sheath 5 together. At this time, the left and right surfaces of the crimped outer fastening portion 22 are substantially parallel to each other.

By the above operation, the inner and outer terminals 11, 12 are mounted on the end of the shielded cable 1 as shown in FIG. 4. Even in this state, the shielding terminal 10 sufficiently fulfils its functions and has particular advantages. Specifically, since the braided wire 4 and the sheath 5 are fastened by the single outer fastening portion 22 by folding the braided wire 4 back around the sheath 5, the length of the shielding terminal 10 can be shortened as compared with conventional shielding terminals in which the braided wire and the sheath are fastened separately. Further, since the inner terminal 11 is mounted in advance outside the outer terminal 12 and the crimped inner fastening portion 18 is located in portions of the covering wall portion 21 of the outer terminal 12 to be surrounded on three sides, shielding characteristics, such as a radiation characteristic, can be improved as compared with conventional shielding terminals in which both upper and lower surfaces are open.

In this embodiment, the cover 14 also is provided. The cover 14 is inserted into the opening 21A in the upper surface of the covering wall portion 21 of the outer terminal 12, as indicated by an arrow in FIG. 4, after the shielded cable 10 is assembled as described above. At this stage, the clip portion 37 of the cover 14 is pushed while the holding pieces 39 thereof are widened against elastic forces to forcibly hold the crimped outer fastening portion 22 from opposite lateral sides. The clip portion 37 stops being pushed when the base plate 38 comes into contact with the upper surface of the outer fastening portion 22, and is fixed by the holding pieces 39 that elastically hold the left and right surfaces of the outer fastening portion 22 while the biting projections 40 bite in these surfaces.

When the cover 14 is mounted as above, the covering portion 35 completely covers from the opening 21A in the upper surface of the covering wall portion 21 to the outer fastening portion 22. Additionally the left and right hanging portions 36 of the covering portion 35 cover open rear portions of the left and right walls of the covering wall portion 21 as shown in phantom line of FIG. 3 and in FIG. 5. As a result, the inner fastening portion 18 of the inner terminal 11 that is fastened to the core 2 of the shielded cable 1 is covered on four sides by the cover 14 and the covering wall portion 21 of the outer terminal 12.

As described above, according to the foregoing embodiment, the cover 14 enables a section of the core 2 exposed from the braided wire 4 to have its fastened portion and a portion near it substantially covered on four sides by the conductive members including the covering wall portion 21 of the outer terminal 12. Therefore, shielding characteristics, such as a radiation characteristic, can be improved remarkably.

Since the cover 14 is mounted on the outer fastening portion 22 of the outer terminal 12 by the clip portion 37, it can be simply mounted and fitted in the outer terminal 12. As a result, the shielding terminal 10 is allowed to have a small size as a whole. Further, the shielding terminal 10 can be securely grounded by employing a clip-lock construction.

Figure 5:
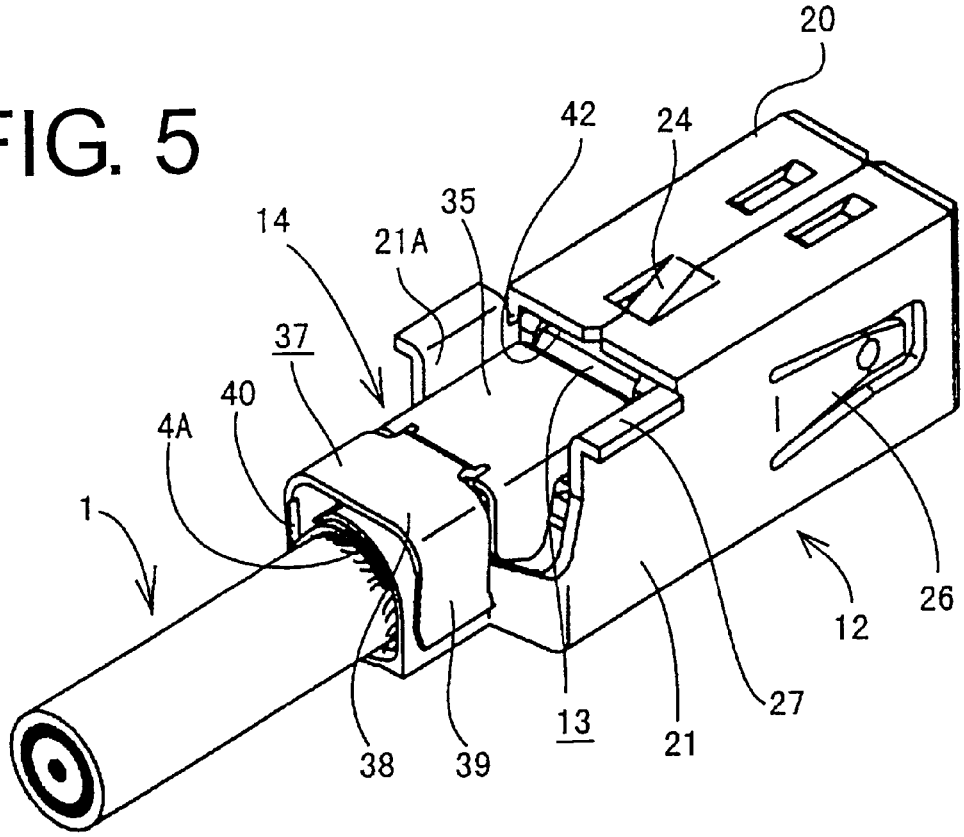
FIG. 5 is a perspective view showing a state where the cover is mounted.
Figure 6:
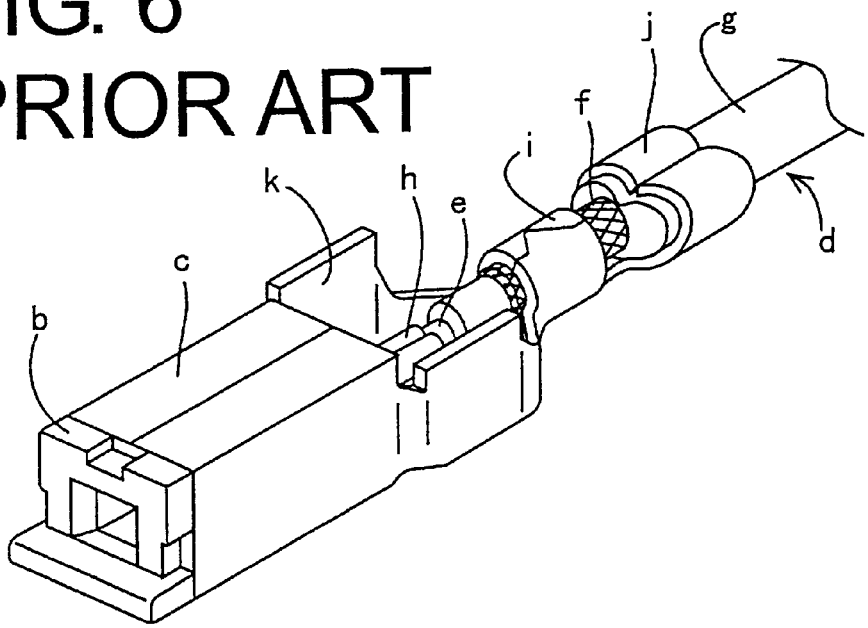
FIG. 6 PRIOR ART
FIG. 6 is a perspective view of a prior art shielding terminal.
Figure 7:
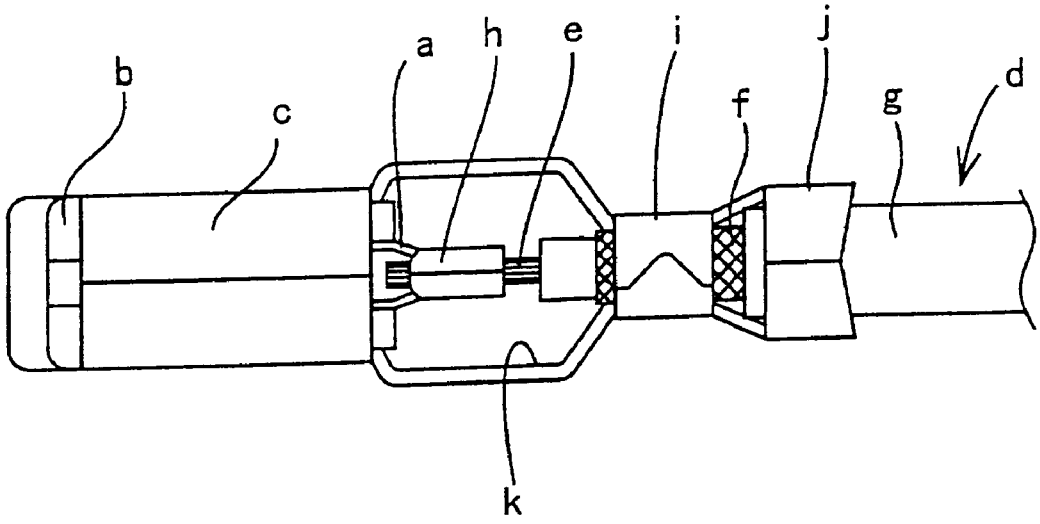
FIG. 7 PRIOR ART
FIG. 7 is a plan view of the prior art shielding terminal.

Furthermore, since the covering portion 35 of the cover 14 is located in a position below the upper surface of the accommodating portion 20 of the outer terminal 12 as shown in FIG. 5, a rear edge 42 of the upper surface of the accommodating portion 20 can act as an engaging portion to be engaged with a resin locking portion provided in a cavity of a housing when the shielding terminal 10 is accommodated into the cavity.

The present invention is not limited to the described and illustrated embodiment but, for example, the following embodiments are also embraced by the technical scope of the present invention as defined in the claims. Besides the following embodiments, a variety of other changes can be made without departing from the scope and spirit of the invention as defined in the claims.

The present invention is also applicable to shielding terminals in which both upper and lower surfaces are open where an end of a core is fastened as in the illustrated prior art.

Although the male shielding terminal is illustrated in the foregoing embodiment, the present invention is similarly applicable to female shielding terminals.

What is claimed is:

1. A shielding terminal, comprising:

a shielded cable having a core, an insulating layer surrounding the core, a shield layer surrounding the insulating layer, the shield layer having an outer surface covered by a sheath, the shielded cable further comprising an end, a selected length of the core being exposed at the end, and a selected length of the shield layer being folded away from the end and over the sheath;

an inner terminal having a rear end crimped into connection with the core and a front end configured for mating with another terminal;

a dielectric element surrounding a portion of the inner terminal between the front and rear ends;

an outer terminal with a fastening portion crimped into connection with portions of the shield layer folded over the sheath for shielding connection to the shield layer and for secure mounting to the sheath, the outer terminal further having an accommodating portion spaced forwardly from the fastening portion, the accommodating portion having opposed top and bottom walls and side walls extending between the top and bottom walls, the dielectric element and portions of the inner terminal forwardly of the crimped connection to the core being received in the accommodating portion, a covering wall portion between the fastening portion and the accommodating portion, the covering wall portion having a bottom wall, a pair of side walls extending upwardly from the bottom wall and an open top, between the side walls; and a cover member extending between the fastening portion and the accommodating portion of the outer terminal and disposed between the side walls of the covering portion and below the top wall of the accommodating portion for substantially covering an exposed portion of the inner terminal crimped to the core.

2. A shielding terminal, comprising:

a shielded cable having a core an insulating layer surrounding the core, a shield layer surrounding the insulating layer, the shield layer having an outer surface covered by a sheath, the shielded cable further comprising an end, a selected length of the core being exposed at the end, and a selected length of the shield layer being folded away from the end and over the sheath;

an inner terminal having a rear end crimped into connection with the core and a front end configured for mating with another terminal;

a dielectric element surrounding a portion of the inner terminal between the front and rear ends:

an outer terminal with a fastening portion crimped into connection with portions of the shield layer folded over the sheath for shielding connection to the shield layer and for secure mounting to the sheath, the outer terminal further having an accommodating portion spaced forwardly from the fastening portion, the dielectric element and portions of the inner terminal forwardly of the crimped connection to the core being received in the accommodating portion, a covering wall portion between the fastening portion and the accommodating portion, the covering wall portion having a bottom wall, a pair of side walls extending upwardly from the bottom wall and an open top, a pair of stabilizers extending outwardly from portions of the side walls spaced from the bottom wall; and a cover member extending between the fastening portion and the accommodating portion of the outer terminal and substantially covering the open top between the side walls of the covering wall portion for covering an exposed portion of the inner terminal crimped to the core.

3. A shielding terminal according to claim 2, wherein the cover member is detachably mounted on the fastening portion of the outer terminal.

4. A shielding terminal according to claim 2, wherein the shield layer is a braided wire.

5. A shielding terminal according to claim 2, wherein the side walls of the covering wall portion have inwardly facing surfaces, the cover member extending between the inwardly facing surfaces of the side walls of the covering wall portion for further covering the crimped connection of the inner terminal to the core.

6. A shielding terminal according to claim 5, wherein a portion of the cover member mountable on the fastening portion of the outer terminal is formed into a clip for elastically holding the fastening portion.

* * * * *